US008092180B2

(12) United States Patent
Liu

(10) Patent No.: US 8,092,180 B2
(45) Date of Patent: Jan. 10, 2012

(54) BLADE ASSEMBLY FOR A CEILING FAN

(75) Inventor: Ching-Wen Liu, Taichung Hsien (TW)

(73) Assignee: Pan Air Electric Co., Ltd, Taichung ( * ) Notice: Subject to any disclaimer, the term of this patent is extended or adjusted under 35 U.S.C. 154(b) by 545 days.

(21) Appl. No.: 12/368,311

(22) Filed: Feb. 10, 2009

(65) Prior Publication Data

US 2010/0202882 A1 Aug. 12, 2010

(51) Int. Cl.
*B63H 1/06* (2006.01)

(52) U.S. Cl. ..... 416/142; 416/143; 416/206 R; 416/210 R; 416/220 R

(58) Field of Classification Search ..... 416/142, 416/143, 206, 210 R, 220 R
See application file for complete search history.

(56) References Cited

U.S. PATENT DOCUMENTS 7,351,037 B1 * 4/2008 Mares et al. ..... 416/210 R

* cited by examiner

*Primary Examiner* — Jack Chen

(57) ABSTRACT

A blade assembly for a ceiling fan includes a mounting arm, a bearing, a cover, a spiral spring, a blade, and three screws. The mounting arm has a plate. The plate has a boss. The boss has a split. The bearing is sleeved on the boss. The cover has a stub. The stub has a receiving recess for receiving the bearing. The cover has a through hole for passing the boss. The cover has three bosses. The spiral spring has one end sleeved on the boss of the cover and the other end engaged with the split. The blade has three mounting holes and corresponding to the boss of the cover. The three screws pass through the mounting holes and fasten with the bosses of the cover.

12 Claims, 7 Drawing Sheets

BLADE ASSEMBLY FOR A CEILING FAN

BACKGROUND OF THE INVENTION

1. Field of the Invention

The present invention relates to ceiling fan, and more particularly to a blade assembly for a ceiling fan.

2. Description of Related Art

A conventional blade assembly for a ceiling fan in accordance with the prior art comprises a mounting arm with one end secured on a rotor and the other end formed as a plate-like blade mounting end which has a plurality of through holes and a plurality of engaging posts extending downwardly from the blade mounting end adjacent to the through holes. A blade member is formed with a plurality of mounting holes, each confined by an inner peripheral wall with a constricted portion to divide the mounting hole into a notch portion and a bore portion. As such, each engaging post can be pressed into the bore portion of the respective mounting hole, and can then be moved into the notch portion via the constricted portion such that a retaining portion thereof rests on a bottom side of the blade member. A cap member has a plurality of resilient engaging plugs with retaining portions. Each engaging plug is inserted into and is fitted snugly in the bore portion of the respective mounting hole such that the retaining portion passes through the through hole for retention on the mounting end. Thus, the blade member can be mounted on the mounting arm.

When the conventional blade member is rigidly mounted on the mounting arm, the total volume of the ceiling fan is huge. Therefore, the blade member, the mounting arm, and the rotor are needed to disassemble for packing and delivering. User/technician needs to assemble them. However, improper assembling may cause the blade member accidentally loosing and resulting in damages to surrounding property and people in the vicinity.

The present invention has arisen to mitigate and/or obviate the disadvantages of the conventional blade assembly for a ceiling fan.

SUMMARY OF THE INVENTION

The main objective of the present invention is to provide an improved blade assembly for a ceiling fan, in that a foldable and expandable ceiling fan is acquired.

To achieve the objective, the blade assembly for a ceiling fan includes a mounting arm, a bearing connected to the mounting arm, a cover connected to the mounting arm, a spiral spring mounted on the cover, a blade mounted on the cover, and at least one screw connected to the blade. The mounting arm has a bracket formed in one end thereof for adapting to be mounted to a motor. The mounting arm has a plate formed in the other end thereof. The plate has a boss extended therefrom. The boss has a split defined in a top thereof. The bearing is sleeved on the boss of the mounting arm. The cover has a stub extended from a bottom thereof. The stub has a receiving recess defined therein for receiving the bearing. The cover has a through hole defined therein for passing the boss of the mounting aim. The cover has at least one boss extended from a top thereof. The spiral spring is sleeved on the boss of the mounting arm. The spiral spring has one end sleeved on the at least one boss of the cover and the other end engaged with the split. The blade has at least one mounting hole defined therein and corresponding to the at least one boss of the cover. The at least one screw passes through the at least one mounting hole and fastens with the at least one boss of the cover such that the blade is securely mounted to the cover.

Further benefits and advantages of the present invention will become apparent after a careful reading of the detailed description with appropriate reference to the accompanying drawings.

DETAILED DESCRIPTION OF THE INVENTION

Figure 1:
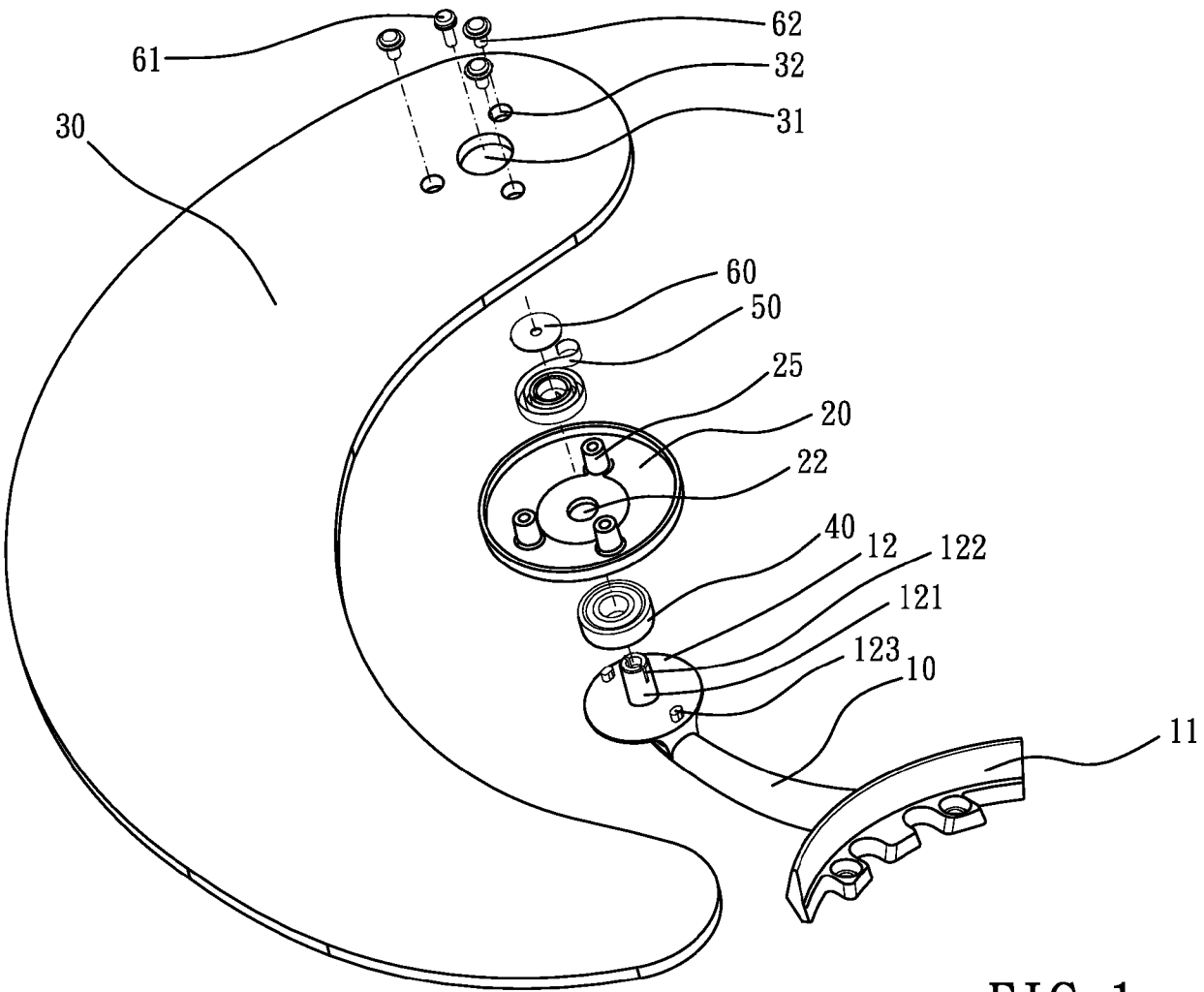
FIG. 1 is an exploded perspective view of a blade assembly for a ceiling fan in accordance with the present invention.
Figure 2:
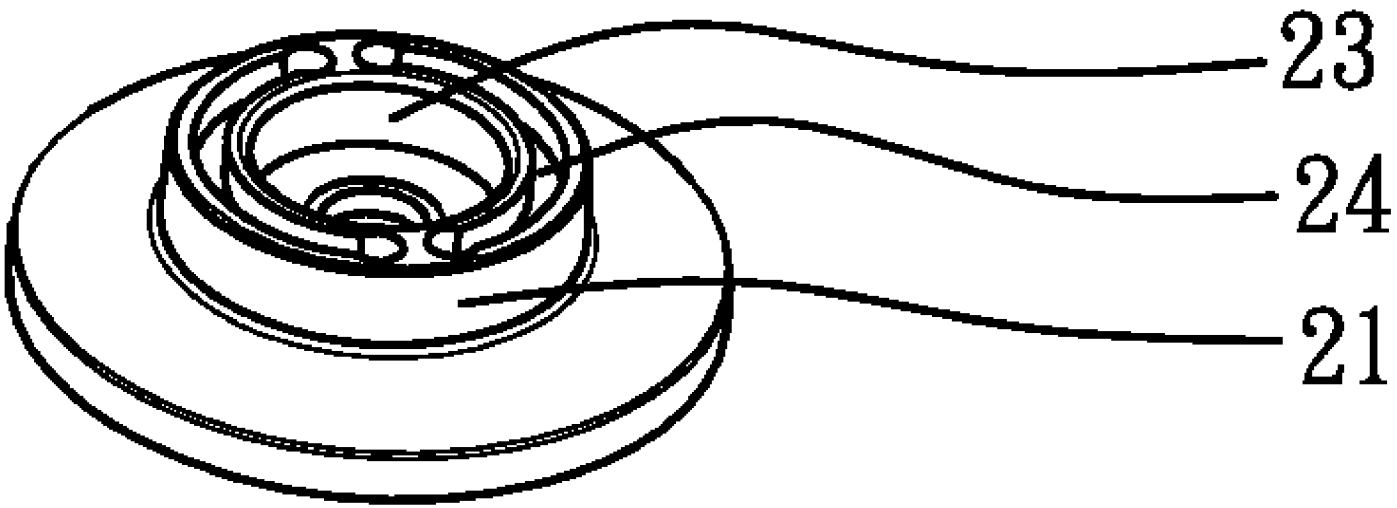
FIG. 2 shows the cover of the blade assembly illustrated in FIG. 1, which is viewed from another orientation.

Referring to the drawings and initially to FIGS. 1-4, a blade assembly for a ceiling fan in accordance with the present invention comprises a mounting arm 10, a cover 20 connected to the mounting aim 10, and a blade 30 connected to the cover 20.

The mounting arm 10 has two ends. The mounting arm 10 has a bracket 11 formed in one end thereof for adapting to be mounted to a motor (not shown). The mounting arm 10 has a plate 12 formed in the other end thereof, which is opposite to the bracket 11. The plate 12 of the mounting arm 10 is in a shape of circle. The plate 12 has a boss 121 centrally and upwardly extended therefrom. The boss 121 has a split 122 defined in a top thereof. The plate 12 has at least one protrusion 123 extended therefrom. In the preferred embodiment, the plate 12 has two protrusions 123.

The cover 20 is in a shape of circle. The cover 20 has a stub 21 extended from a bottom thereof. The cover 20 has a through hole 22 defined in a center thereof for receiving the boss 121. The boss 121 protrudes from the cover 20. The stub 21 has a receiving recess 23 defined therein for receiving a bearing 40. When assembling, the bearing 40 is sleeved on the boss 121 and received in the receiving recess 23 such that the cover 20 stably rotates around the boss 121 of the plate 12. A tight fit between the boss 121 and the bearing 40 is preferred. A tight fit between the receiving recess 23 and the bearing 40 is preferred. The stub 21 further has at least one curviform groove 24 defined therein and corresponding to the at least one protrusion 123 of the plate 12. In the preferred embodiment, the stub 21 has two curviform grooves 24. The at least one protrusion 123 of the plate is received in the at least one curviform groove 24 in the stub 21 such that the cover 20 rotates relative to the mounting arm 10 in a predefined angle.

The cover 20 has at least one boss 25 extended from a top thereof. In the preferred embodiment, the cover 20 has three bosses 25.

The blade assembly for a ceiling fan in accordance with the present invention further comprises a spiral spring 50. The spiral spring 50 is disposed on the top of the cover 20 and sleeved on the boss 121 of the plate 12. One end of the spiral spring 50 is sleeved on the at least one boss 25 of the cover 20 and the other end of the spiral spring 50 is engaged with the split 122 in the boss 121 of the plate 12.

The blade 30 is in a shape of crescent moon. The blade 30 has an installing hole 31 defined therein and extended therethrough. The installing hole 31 is corresponding to the boss 121 of the plate 12. A washer 60 is disposed on the top of the boss 121 of the plate 12 and abutted against the spiral spring 50. When assembling, a screw 61 passes through the wash 60 via the installing hole 31 and fastens with the boss 121 of the plate 12 to prevent the spiral spring 50 from shooting out. The blade 30 further has at least one mounting hole 32 defined therein and corresponding to the at least one boss 25 of the cover 20. When assembling, at least one screw 62 passes through the at least one mounting hole 32 and fastens with the at least one boss 25 of the cover 20 such that the blade 30 is securely mounted on the cover 20. In the preferred embodiment, the blade 30 has three mounting holes 32 corresponding to the three bosses 25 of the cover 20 such that the fastening force is balanced to firmly fasten the cover 20 with the blade 30.

Figure 4:
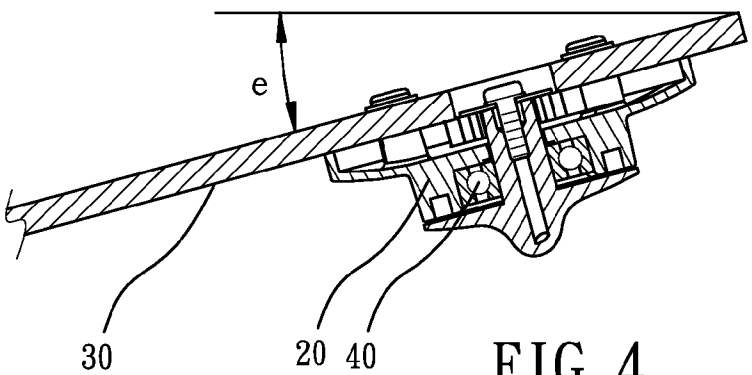
FIG. 4 is a partial cross-sectional view of the blade assembly taken along line 4-4 in FIG. 3.
Figure 3:
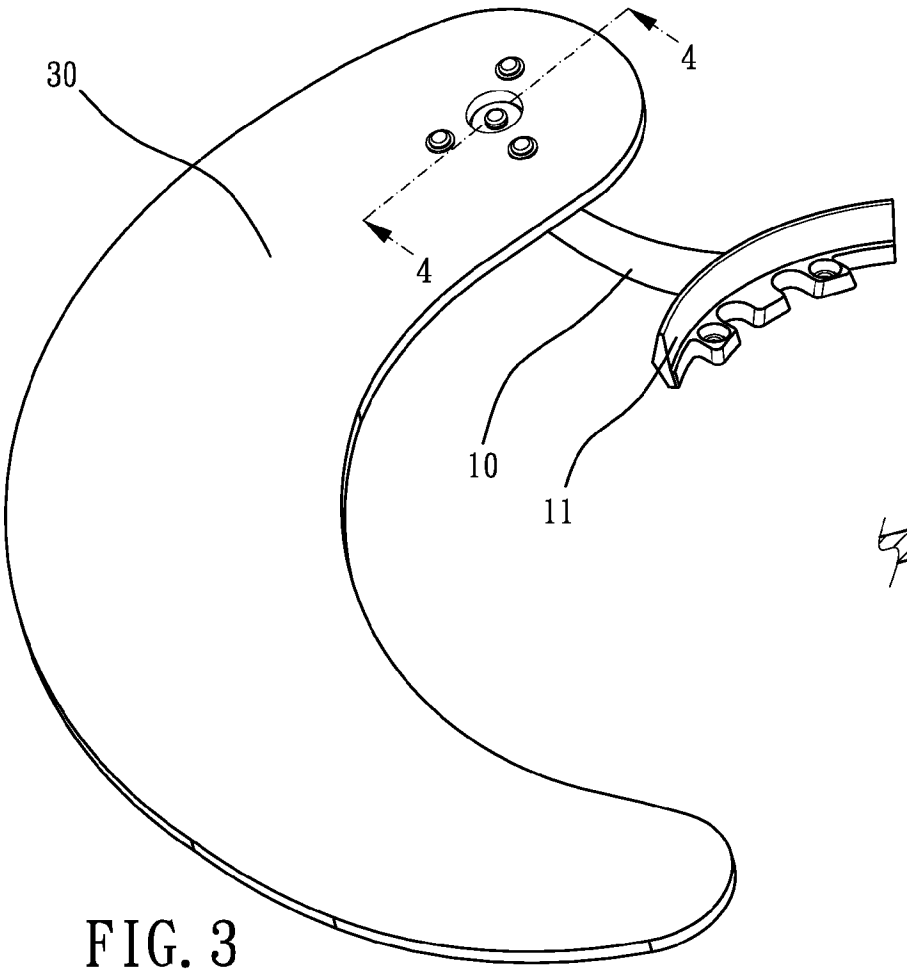
FIG. 3 is an assembled perspective view of the blade assembly in accordance with the present invention.

FIG. 4 shows that the blade of the blade assembly is tilted. An angle e is defined between the blade 30 and a ceiling (not shown) such that the blade assembly causes more turbulence to enhance the air flow.

Figure 5:
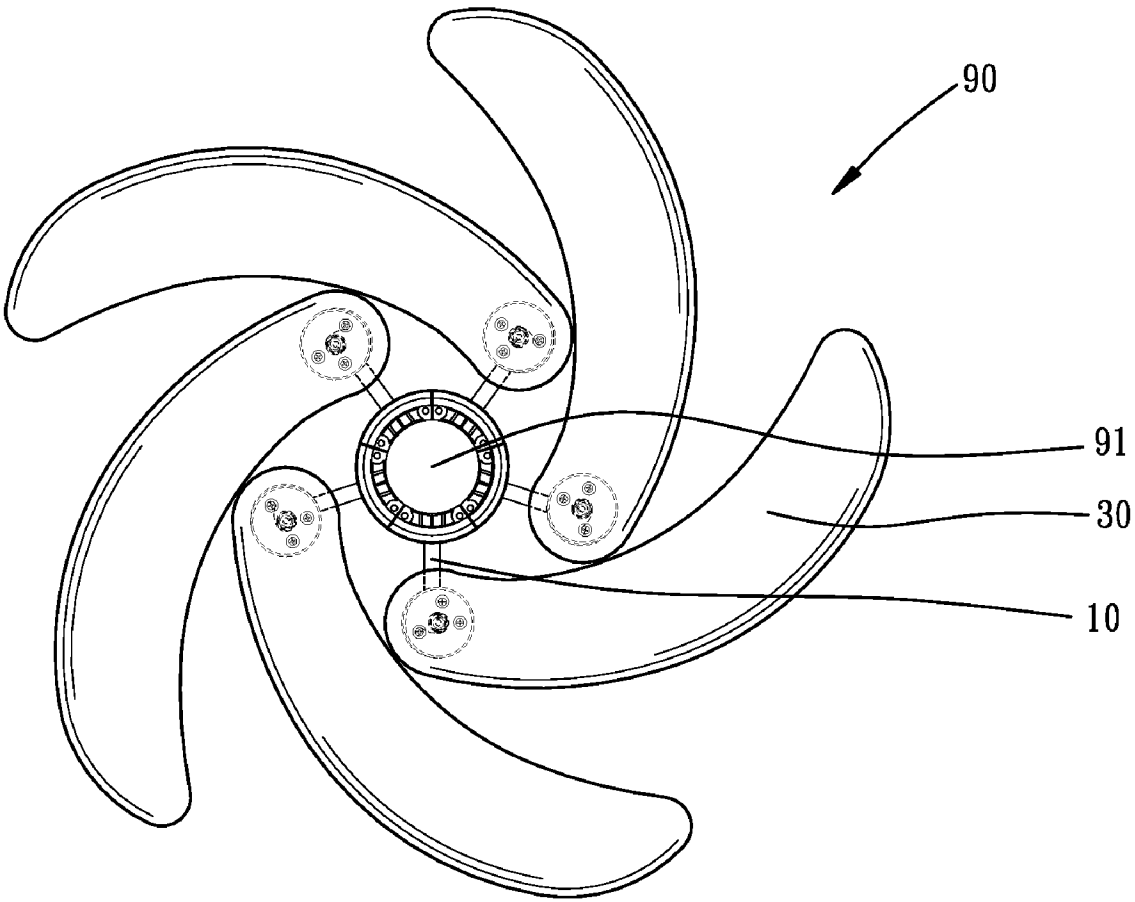
FIG. 5 is a bottom plan view of the ceiling fan in accordance with the present invention, showing the ceiling fan is folded.
Figure 6:
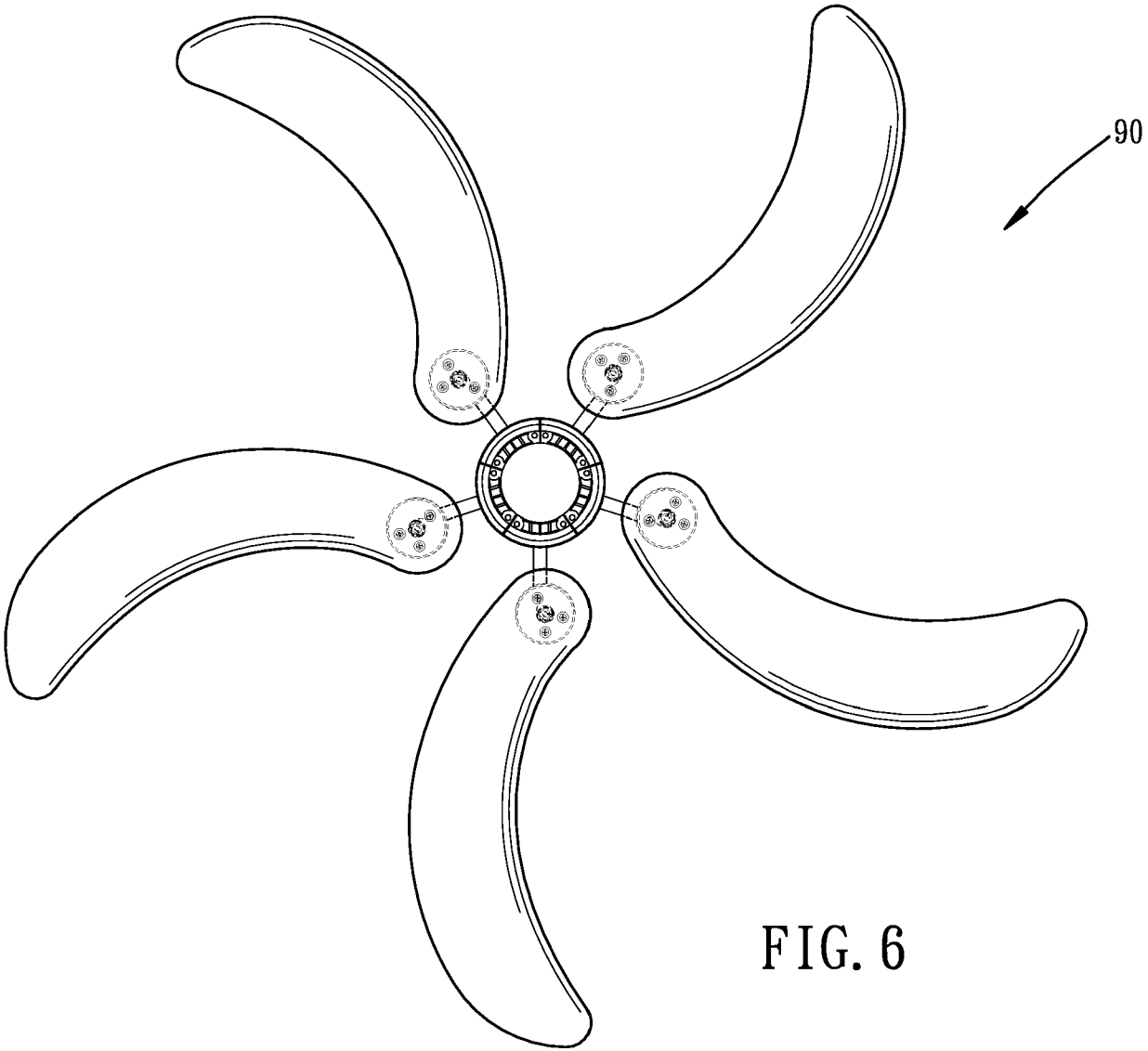
FIG. 6 is a bottom plan view of the ceiling fan in accordance with the present invention, showing the ceiling fan is expanded.

Referring to FIGS. 5 and 6, the operation of the blade assembly in accordance with the present invention is illustrated. A ceiling fan 90 is assembled by multiple blade assemblies and a motor 91. When turning off the ceiling fan 90, each blade 30 is subjected to a compressive force of the spiral spring 50 such that each blade 30 is folded as shown in FIG. 5. Therefore, a total volume of the ceiling fan 90 is small. When turning on the ceiling fan 90, each blade 30 is subjected to a centrifugal force caused by the rotation of the motor 91. The centrifugal force is greater than the compressive force such that each blade 30 rotates around the boss 121 of mounting arm 10 to compress the spiral spring 50. When the centrifugal force is equivalent to the compressive force or the at least one protrusion 123 of the plate 12 is in an edge of the at least one curviform groove 24 in the stub 21, each blade 30 is expanded as shown in FIG. 6. The expanded ceiling fan 90 causes more turbulence to enhance the air flow. The bearing 40 is disposed between the boss 121 of the mounting arm 10 and the cover 20 such that the cover 20 stably rotates relative to the mounting arm 10 to reduce the possibility of vibration.

Figure 7:
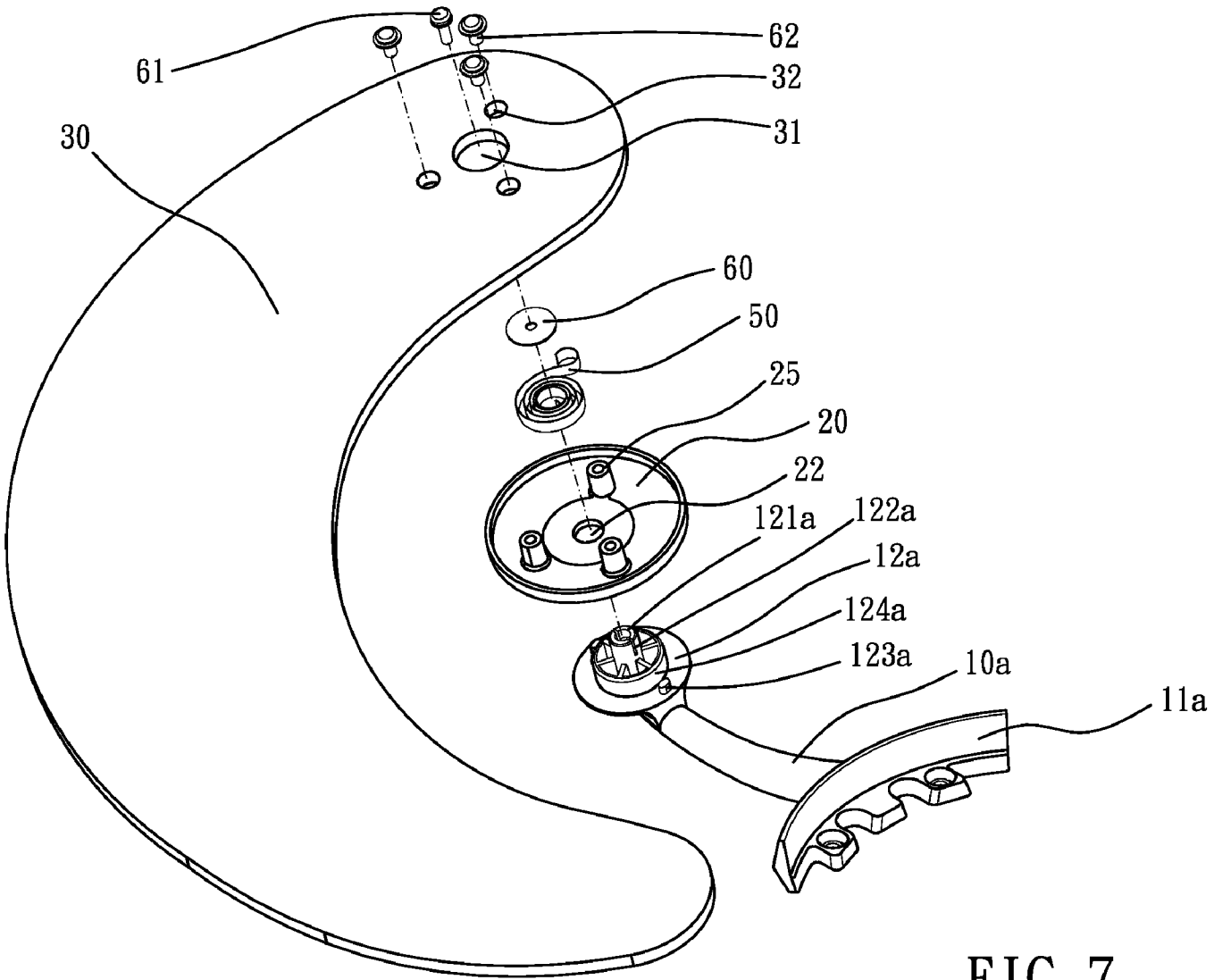
FIG. 7 is an exploded perspective view of a second embodiment of a blade assembly for a ceiling fan in accordance with the present invention.
Figure 9:
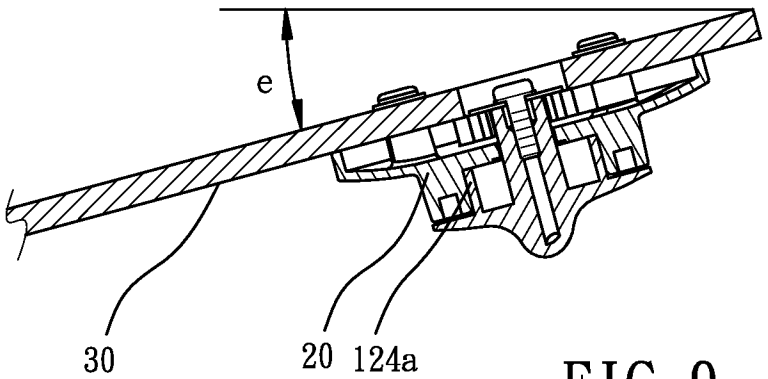
FIG. 9 is a partial cross-sectional view of the blade assembly taken along line 9-9 in FIG. 8.
Figure 8:
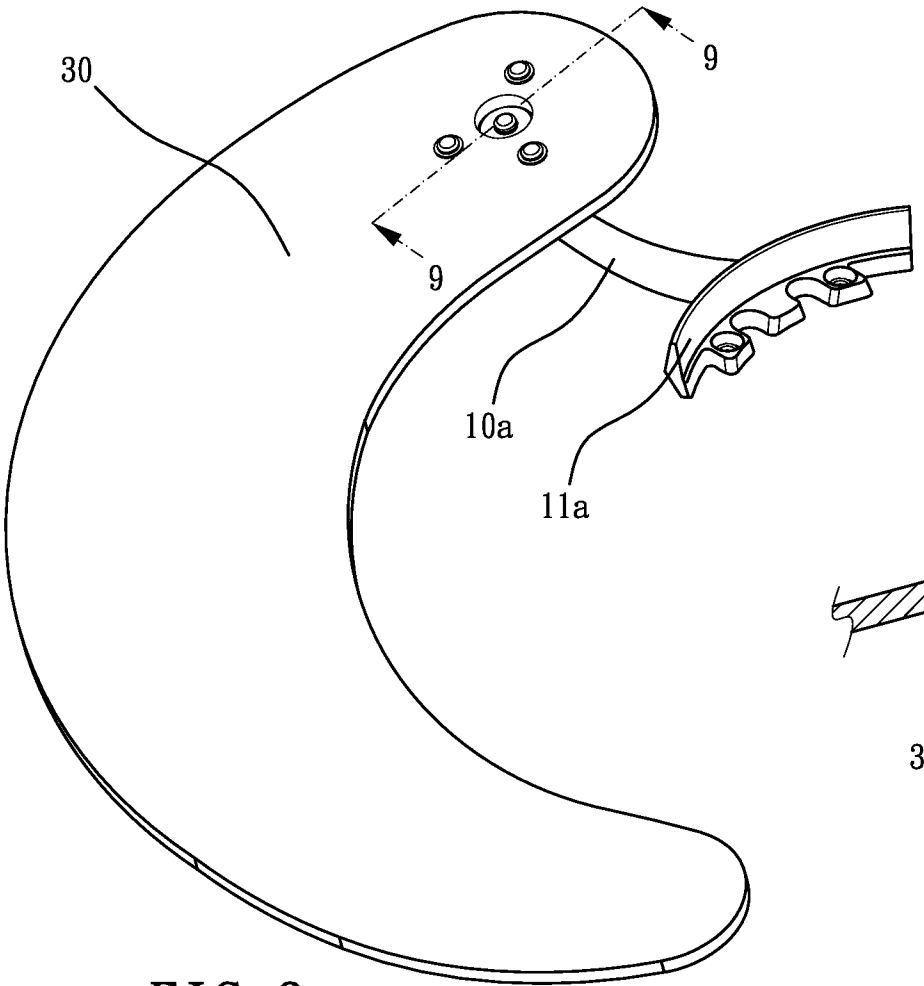
FIG. 8 is an assembled perspective view of the second embodiment of the blade assembly in accordance with the present invention.

Referring to FIGS. 7-9, a second embodiment of a blade assembly for a ceiling fan in accordance with the present invention is illustrated. The elements and effects of the second embodiment which are the same with the first embodiment are not described, only the differences are described. The plate 12*a* has a stub 124*a* centrally and upwardly extended from a top thereof. The stub 124*a* is lower than the boss 121*a*. The stub 124*a* is received in the receiving recess 23 of the cover 20. A loose fit between the receiving recess 23 and the stub 124*a* is preferred. Therefore, the cover 20 stably rotates relative to the mounting arm 10*a* to reduce the possibility of vibration.

Although the invention has been explained in relation to its preferred embodiment, it is to be understood that many other possible modifications and variations can be made without departing from the spirit and scope of the invention as hereinafter claimed.

What is claimed is:

1. A blade assembly for a ceiling fan comprising:

a mounting arm having a bracket formed in one end thereof for adapting to be mounted to a motor, the mounting arm having a plate formed in the other end thereof, the plate having a boss extended therefrom, the boss having a split defined in a top thereof;

a bearing sleeved on the boss of the mounting arm;

a cover connected to the mounting arm, the cover having a stub extended from a bottom thereof, the stub having a receiving recess defined therein for receiving the bearing, the cover having a through hole defined therein for passing the boss of the mounting arm, the cover having at least one boss extended from a top thereof;

a spiral spring mounted on the cover and sleeved on the boss of the mounting arm, the spiral spring having one end sleeved on the at least one boss of the cover and the other end engaged with the split;

a blade mounted on the cover, the blade having at least one mounting hole defined therein and corresponding to the at least one boss of the cover; and at least one screw passing through the at least one mounting hole and fastening with the at least one boss of the cover such that the blade is securely mounted to the cover.

2. The blade assembly for a ceiling fan as claimed in claim 1, wherein the plate has at least one protrusion extended therefrom; the stub of the cover has at least one curviform groove defined therein and corresponding to the at least one protrusion.

3. The blade assembly for a ceiling fan as claimed in claim 1 further comprising a washer and a screw, the washer disposed on the top of the boss of the mounting arm and abutted against the spiral spring, the screw passing the washer and fastening with the boss of the mounting arm for preventing the spiral spring from shooting out.

4. The blade assembly for a ceiling fan as claimed in claim 3, wherein the blade has an installing hole defined therein and extended therethrough for installing the washer and the screw.

5. The blade assembly for a ceiling fan as claimed in claim 1, wherein the blade is in a shape of crescent moon.

6. The blade assembly for a ceiling fan as claimed in claim 1, wherein the bearing and the boss of the mounting arm is in a tight fit; the bearing and the receiving recess is in a tight fit.

7. A blade assembly for a ceiling fan comprising:

a mounting arm having a bracket formed in one end thereof for adapting to be mounted to a motor, the mounting arm having a plate formed in the other end thereof, the plate having a boss extended therefrom, the boss having a split defined in a top thereof, the plate having a stub extended therefrom, the stub being lower than the boss;

a cover connected to the mounting arm, the cover having a stub extended from a bottom thereof, the stub of the cover having a receiving recess defined therein for receiving the stub of the mounting arm, the cover having a through hole defined therein for passing the boss of the mounting arm, the cover having at least one boss extended from a top thereof;

a spiral spring mounted on the cover and sleeved on the boss of the mounting arm, the spiral spring having one end sleeved on the at least one boss of the cover and the other end engaged with the split;

a blade mounted on the cover, the blade having at least one mounting hole defined therein and corresponding to the at least one boss of the cover; and at least one screw passing through the at least one mounting hole and fastening with the at least one boss of the cover such that the blade is securely mounted to the cover.

8. The blade assembly for a ceiling fan as claimed in claim 7, wherein the plate has at least one protrusion extended therefrom; the stub of the cover has at least one curviform groove defined therein and corresponding to the at least one protrusion.

9. The blade assembly for a ceiling fan as claimed in claim 7 further comprising a washer and a screw, the washer disposed on the top of the boss of the mounting arm and abutted against the spiral spring, the screw passing the washer and fastening with the boss of the mounting aim for preventing the spiral spring from shooting out.

10. The blade assembly for a ceiling fan as claimed in claim 9, wherein the blade has an installing hole defined therein and extended therethrough for installing the washer and the screw.

11. The blade assembly for a ceiling fan as claimed in claim 7, wherein the blade is in a shape of crescent moon.

12. The blade assembly for a ceiling fan as claimed in claim 7, wherein the stub of the mounting arm and the receiving recess is in a loose fit.

* * * * *